US006488057B1

(12) United States Patent
Tatsuno

(10) Patent No.: US 6,488,057 B1
(45) Date of Patent: Dec. 3, 2002

(54) FUELING SYSTEM

(75) Inventor: Hiyoshi Tatsuno, Tokyo (JP)

(73) Assignee: Tatsuno Corporation, Tokyo (JP)

( * ) Notice: Subject to any disclaimer, the term of this patent is extended or adjusted under 35 U.S.C. 154(b) by 0 days.

(21) Appl. No.: 09/617,276

(22) Filed: Jul. 17, 2000

(30) Foreign Application Priority Data

Jan. 4, 2000 (JP) ..... 2000-000013

(51) Int. Cl.[7] ..... B67D 5/32

(52) U.S. Cl. ..... 141/94; 141/98; 141/232; 141/231; 705/413; 137/234.6; 222/14; 222/23

(58) Field of Search ..... 141/94, 98, 231, 141/232; 222/14, 23, 25–28; 137/234.6; 700/231, 237, 241, 236, 232; 705/413

(56) References Cited

U.S. PATENT DOCUMENTS 3,883,042 A * 5/1975 Junker ..... 222/23
4,250,550 A * 2/1981 Fleischer ..... 222/23
4,627,552 A * 12/1986 Yoshida et al. ..... 222/14
5,634,503 A * 6/1997 Musil et al. ..... 141/232
5,671,786 A * 9/1997 Corfitsen ..... 141/94
5,913,180 A * 6/1999 Ryan ..... 705/413
5,954,102 A * 9/1999 Sato et al. ..... 141/94
6,068,030 A 5/2000 Tatsuno ..... 141/94

FOREIGN PATENT DOCUMENTS

JP 2000034000 2/2000

* cited by examiner

*Primary Examiner*—J. Casimer Jacyna
(74) *Attorney, Agent, or Firm*—Birch, Stewart, Kolasch & Birch, LLP

(57) ABSTRACT

A fueling system to be provided in a gas station is disclosed, which comprises at least one fueling machine, and a data input/output unit, the data input/output unit being movable in a required direction, and a fueling data being input from the data input/output unit and being output to the fueling machines.

17 Claims, 6 Drawing Sheets

FUELING SYSTEM

BACKGROUND OF THE INVENTION

1. Field of the Invention

The present invention relates to a fueling system to be installed in a gas station, particularly to a fueling system, of which essential fueling operations are carried out by fueling operators, and supplemental operations such as fueling data input and clearing off are carried out by a customer sitting in a car.

2. Discussion of Related Art

There exist a variety of fueling systems, such as a system designed to be used as self-service machinery, and a system aimed to be operated by fueling operators. The former system is advantageous in view of reducing cost with the elimination of fueling operators from a gas station. In a latter system, there is such an advantage that a customer does not have to perform a fueling operation, who may be unaccustomed to fueling operation, the fueling operation sometimes being accompanied with danger in handling fueling equipment such as a fueling nozzle. Moreover, the customers avoid dirtying hands or clothes by mistake, and are not directly annoyed with the odor of fuel vapor, which is not good for health.

A fueling system which is designed to be operated mainly by fueling operator is disclosed, for instance, in Japanese Patent Application 10(1998)-219757, that has a full-tank fueling function and a fuel-sort discrimination function. By the use of this system, it is possible to decrease the number of fueling operators by the reduction of labor, so that cost reduction is effectively performed. There is, however, such a case that the arrival of a customer escapes fueling operator's attention when the operator is concentrated on some other job such as other customer's fueling. In this case, the newly arrived customer may feel inconvenience. Moreover, it is sometimes inconvenient for a customer to get off his car for settlement.

SUMMARY OF THE INVENTION

It is therefore an object of the present invention to provide a fueling system wherein the substantial fueling operation is carried out by fueling operators and other supplementary operations such as the input of fueling data and settlement is carried out by a customer sitting in a car, thereby effectively eliminating the number of fueling operators without giving the customer a feeling of inconvenience.

The above object of the present invention is attained by a fueling system to be provided in a gas station comprising at least one fueling machine, and a data input/output unit, the data input/output unit being movable in a required direction, and a fueling data being input from the data input/output unit and being output to the fueling machines.

The above object can also be attained by a fueling system to be provided in a gas station comprising a plurality of fueling machines, at least one data input/output unit which is movable by a conveyance unit, a fueling data being input from the data input/output unit and being output to the fueling machines, and entry sensors, each for sensing a car at a fueling area wherein fueling operation is performed, the data input/output unit being moved toward the car by means of the conveyance unit with the detection of a signal from each of the entry sensors.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
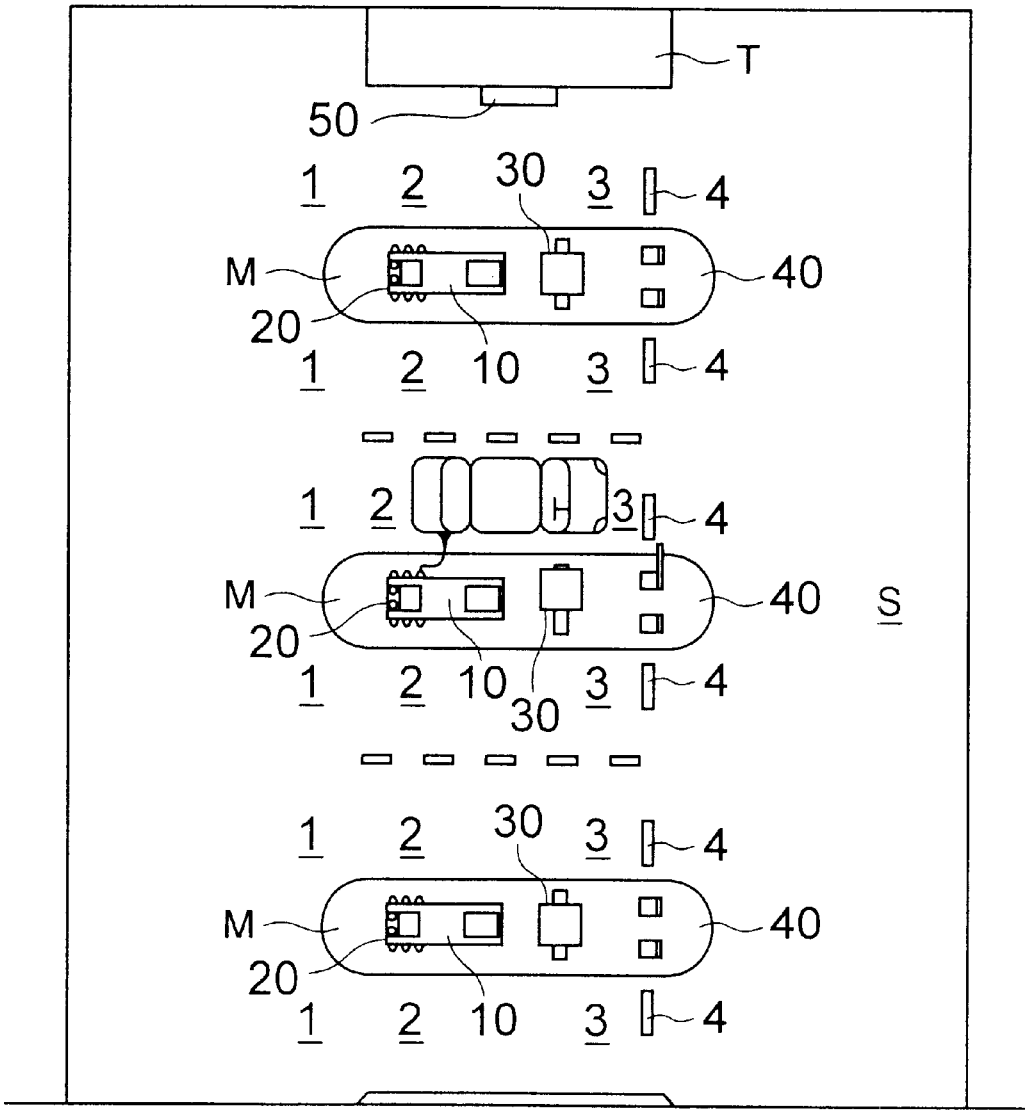
FIG. 1 is a plan view of a gas station for roughly explaining the entire arrangement of a gas station wherein a fueling system of the present invention can be provided.

A first fueling system of the present invention to be provided in a gas station comprises at least one fueling machine, and a data input/output unit. The data input/output unit is movable in a required direction, and a fueling data is input from the data input/output unit and output to the fueling machines. A second fueling system of the present invention to be provided in a gas station comprises a plurality of fueling machines, at least one data input/output unit which is movable by a conveyance unit, and entry sensors, each for sensing a car at a fueling area wherein fueling operation is performed. The data input/output unit being moved toward the car by means of the conveyance unit with the detection of a signal from each of the entry sensors, and the fueling data is input from the data input/output unit and output to the fueling machines.

By use of the fueling system of the present invention, a customer can input fueling information such as fueling sort or amount by himself under the sitting state in the car since the data input/output unit moves toward the customer's car by sensing the existence of the car. Namely, the customer can take partial charge of jobs in the gas station to facilitate the fueling operation in view of cost, time or the like.

It is preferable that the fueling system to be provided in a gas station have a fuel-state communicator for indicating the fueling states of the fueling machine(s) by the receipt of signals from the data input/output unit and the fueling machines. By the provision of the fuel-state communicator, the fueling operator can recognize the fueling requirement speedily. The fuel-state communicator may be provided at a place visible from most of the gas station and/or on each of the fueling machine. In the case where the fuel-state communicator is provided on each fueling machine, the fueling machine which is required to be operated can easily be identified. When only one fuel-state communicator is provided in a fuel-state communicator, the installation cost can be reduced.

Furthermore, it is preferable that the data input/output unit further have a function of settling a fueling account. This movable data input/output unit with the settling function gives the merit to a customer that the customer can clear off the fueling fee without getting off the car.

In order to obtain an improved operational efficiency, it is preferable to provide in the fuel-state communicator an indication lamp which is turned on, turned on and off, and turned off depending upon the fueling states, which indication lamp let people in the gas station visually know the fueling states.

In addition to the above, it is possible to provide in the fuel state communicator a sound machine which auditory indicates the fueling states. The sound machine can be designed as an apparatus giving a peculiar sound depending upon fueling areas and/or fueling states.

Other feature of this invention will become apparent in the course of the following description of exemplary embodiments, which are given for illustration of the invention and are not intended to be limiting thereof.

FIG. 1 shows a plan view of a gas station S wherein there are provided a plurality of islands M; and the area at the both sides of the islands are called here entry passages 1, fueling areas 2, and leave passages 3 successively. Furthermore, stop line 4 is drawn in each of the leave passages 3. In this figure, a fueling machine 10 and a data input/output unit 30 are provided side by side on each of the islands M, and an individual fuel-state communicator 20 for indicating fueling states of the fueling machine is arranged on the top of the fueling machine 10. Furthermore, interceptors 40 are provided on each of the islands M at the parts facing the leave passage 3. A central fuel-state communicator 50 for communicating the fueling states of the fueling machines 10 is provided at a part which can be seen from the most parts in the gas station S, particularly from the fueling areas 2, for instance on an outer wall of an office building T in the gas station S.

Figure 2:
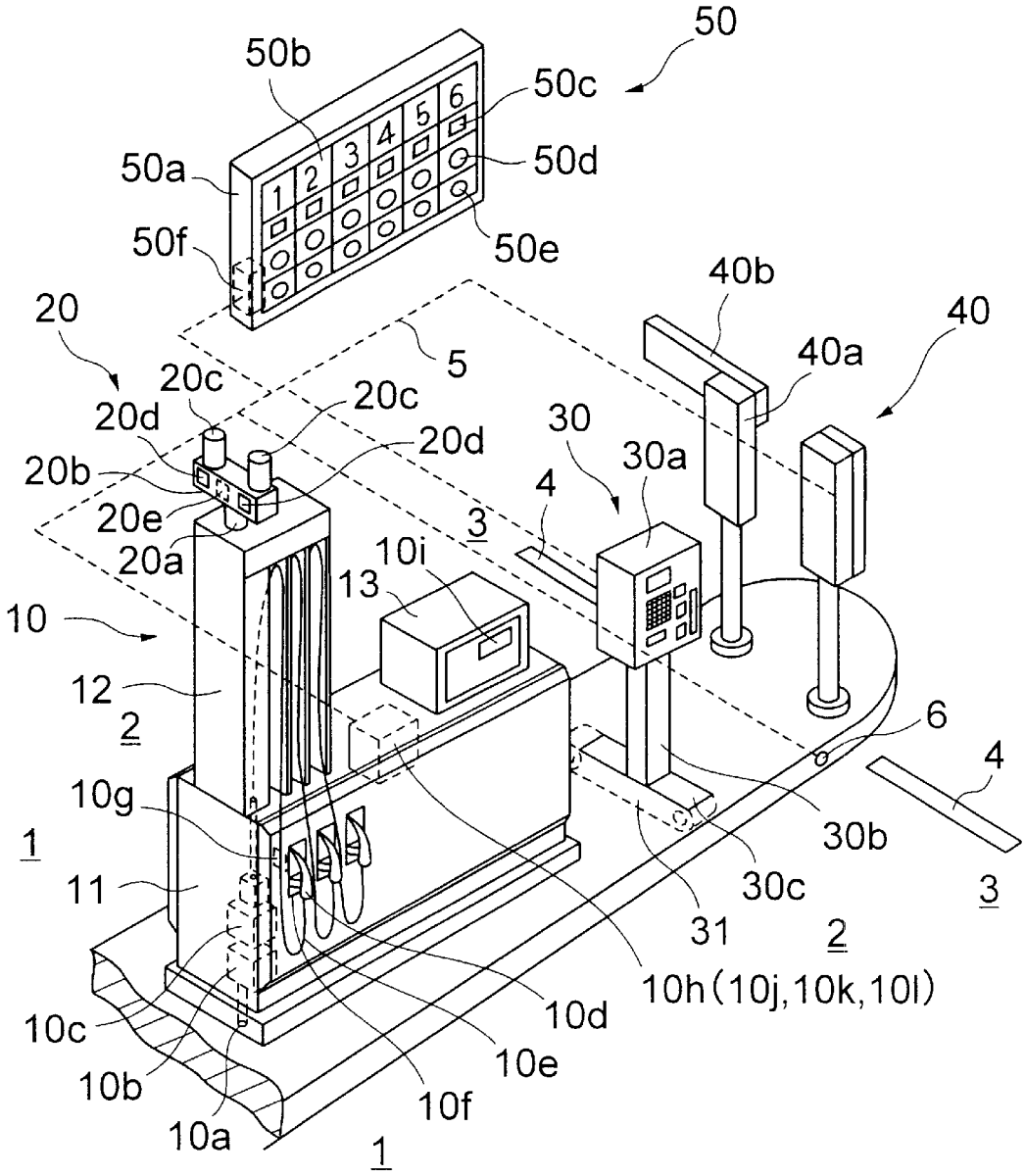
FIG. 2 is a perspective view of a fueling system of the present invention for showing a representative structure thereof.

As shown in a perspective view of a fueling system in FIG. 2, a fueling machine 10, an individual fuel-state communicator 20, a data input/output unit 30, and interceptors 40, each on an island M are connected with a central fuel-state communicator 50 by signal lines 5. Furthermore, an entry sensor for sensing a car entry is provided on the island at the both side faces thereof, namely facing fueling areas 2. The signal from the entry sensor 6 is transmitted to the above-mentioned constituents of the fueling system according to the present invention via the signal lines 6. The fueling machine 10 is composed of a main-body casing 11 wherein two sets (for both faces) of three fuel lines respectively for premium, regular and diesel are incorporated; a post 12 provided in a raised state on the main-body casing 11 at one side thereof, and a display casing 13 on the main-body casing 11 at the other side thereof.

Underground fuel tanks (not shown) containing therein different sorts of fuels are respectively communicating with fueling pipes 10*a*, and then with pumps 10*b* and flow meters 10*c*. The outlets of the flow-meters 10*c* are connected to pipes which are then connected to fueling hoses 10*e* with fueling nozzles 10*d* being provided at the tips thereof. The three fueling hoses 10*e* are suspended from the top of the post 12 on the front and back faces thereof, and the fueling nozzles 10*d* are hung on nozzle rests 10*f* provided on a lateral surface of the main-body casing 11 under the post 12. Each of the nozzle rests 10*f* is provided with a nozzle switch 10*g* for detecting "on" and "off" of the fueling nozzle 10*d*. There is a display 10*i* on the display casing 13 for indicating thereon information such as fueling quantity.

Furthermore, the fueling machine 10 contains a control part 10*h*. The control part 10*h* (which contains in this embodiment a fuel sort discrimination unit 10*j*, a full-tank fuel unit 10*k*, and a pre-set fuel unit 10*l*) causes the indicated value of a previously fueled quantity on to the display 10*i* to turn back to zero when the control part 10*h* receives a nozzle off signal, and thereafter causes the pump 10*b* to be driven. Then, the control part 10*h* causes the fuel-sort discrimination unit 10*j* to discriminate fuel sorts by the output of a fueling initiation signal. The control part 10*h* further outputs signals to drive the full-tank fuel unit 10*k* and the pre-set fuel unit 101, calculates flow amount signals obtained from the flow-meter 10*c*, and indicates the fuel amount obtained by the calculation on to the display 10*i*. When judges that a required fueling amount has been supplied, the control part 10*h* causes the pump 10*b* to stop working with outputting a fuel suspension signal. The control part 10*h* outputs a fuel completion signal by receiving a nozzle-on signal. In addition, the control part 10*h* outputs a wrong-fuel signal in the case where the fuel-sort discrimination unit detects that the fuel already existing in the tank of a car is not consistent to a selected fuel.

The afore-mentioned individual fuel-state communicator 20 is for individually indicating the fueling state of each of the fueling machines 10, which communicator 20 is composed of an individual-communicator post 20*a*, an individual-communicator casing 20*b* placed on the individual-communicator post 20*a*; an individual-communicator indication lamp provided on the individual-communicator casing 20*b*; an individual-communicator sound machine 20*d* which is provided on the casing 20*b* and gives a sound different depending upon the fueling areas 2; and an individual-communicator control section 20*e* for controlling the functions of the indication lamp 20*c* and the sound machine 20*d* upon the receipt of signals from the fueling machine 10 and the data input/output unit 30.

The data input/output unit 30 in the embodiment shown in FIG. 2 is placed upon an island M composed in such a fashion that a housing 30*a* in a box shape is adjusted on a support 30*b* as being movable on a travel path 30*c* back and forth between both sides of the island M. When the entry sensor 6 detects the existence of a customer's car, a conveyance unit 31 causes the support 30*b* to move the data input/output unit 30 toward the fueling area 2 where the car is there.

The conveyance unit 31 is provided in (or provided to be engaged in) the travel path 30*c*, as being composed, for instance, of an endless belt or chain as to be rotated in one and the reversed directions with respect to the longitudinal direction thereof by means of one of conventional actuators such as a motor by the aid of rollers, and limit sensors such as photo-transistors to stop the support by sensing the contact or approach thereof.

Figure 3:
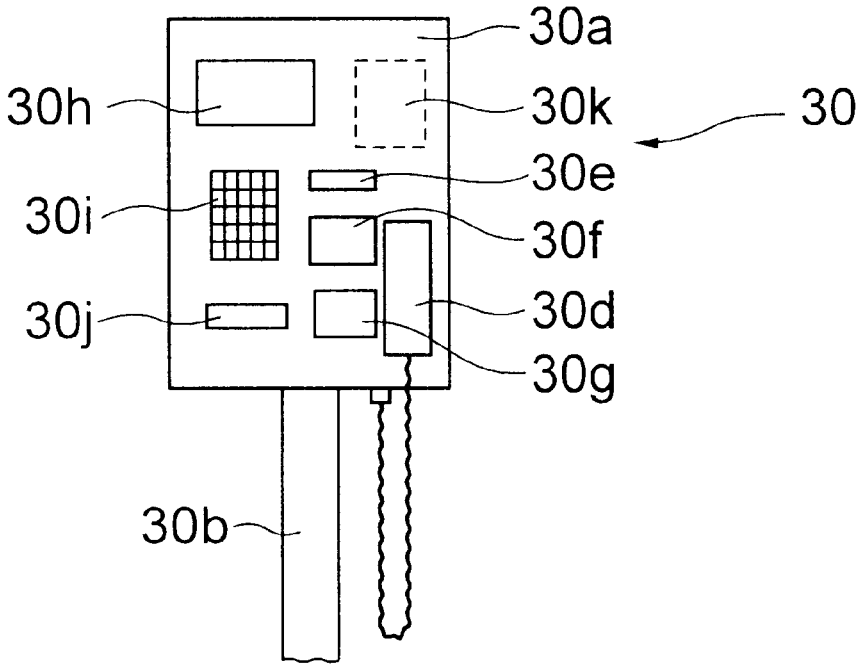
FIG. 3 is an elevation of a data input/output unit for use in the present invention.

As shown in an elevation of FIG. 3, the data input/output unit 30 has on each surface thereof, a data input mobile 30*d* of which one end is connected to the housing 30*a* on the support 30*b* with a line, a card insertion port 30*e* for inserting a card such as a credit card, a money insertion port 30*f*, and a change port 30*g* which is for giving change at the clearing off stage after the completion of the fueling, an indication part 30*h*, a keyboard 30*i* for inputting data therefrom, a printer 30*j* for issuing a fueling data slip, and a control portion 30*k*. The control portion 30*k* which has received a detection signal from the entry sensor 6 causes the conveyance unit 31 to be driven, outputs a fuel-require signal, and a liquidation completion signal after the liquidation being completed. The data input mobile 30*d* in this embodiment is connected to the housing 30*a* with a line. It is possible in this embodiment to prevent the data input mobile 30*d* from being stolen. The data input mobile 30*d*, however, can be prepared as wireless.

In FIG. 2, each of interceptors 40, which are provided on the island M facing leave passages 3, is composed of a leg

40*a* and an interception arm 40*b* on the leg 40*a*. When a fuel-require signal is input from the data input/output unit 30 to the interceptor 40, the interception arm 40*b* rotates to be horizontally protruded for preventing a car for which fueling is being performed or has been completed before clearing off. The interceptor 40 in this state is called here as being in a leave-impossible position.

The central fuel-state communicator 50, which is provided e.g. on an outer wall of an office, has a central-communicator casing 50*a*. The communicator 50 in this embodiment has a fuel-machine-number indication part 50*b* on the front surface thereof, sound machines 50*c* which auditory indicate fueling states by different sounds depending upon the fueling areas; central-communicator indication lamps 50*d* for visually communicating fueling states of the fueling machines 10; liquidation state indicators 50*e*; and a central-communicator control section 50*f*. The central-communicator control section 50*f* controls the function of the communicator 50 based on the fuel-require signal fuel suspension signal, fuel completion signal, and liquidation completion signal.

Figure 4:
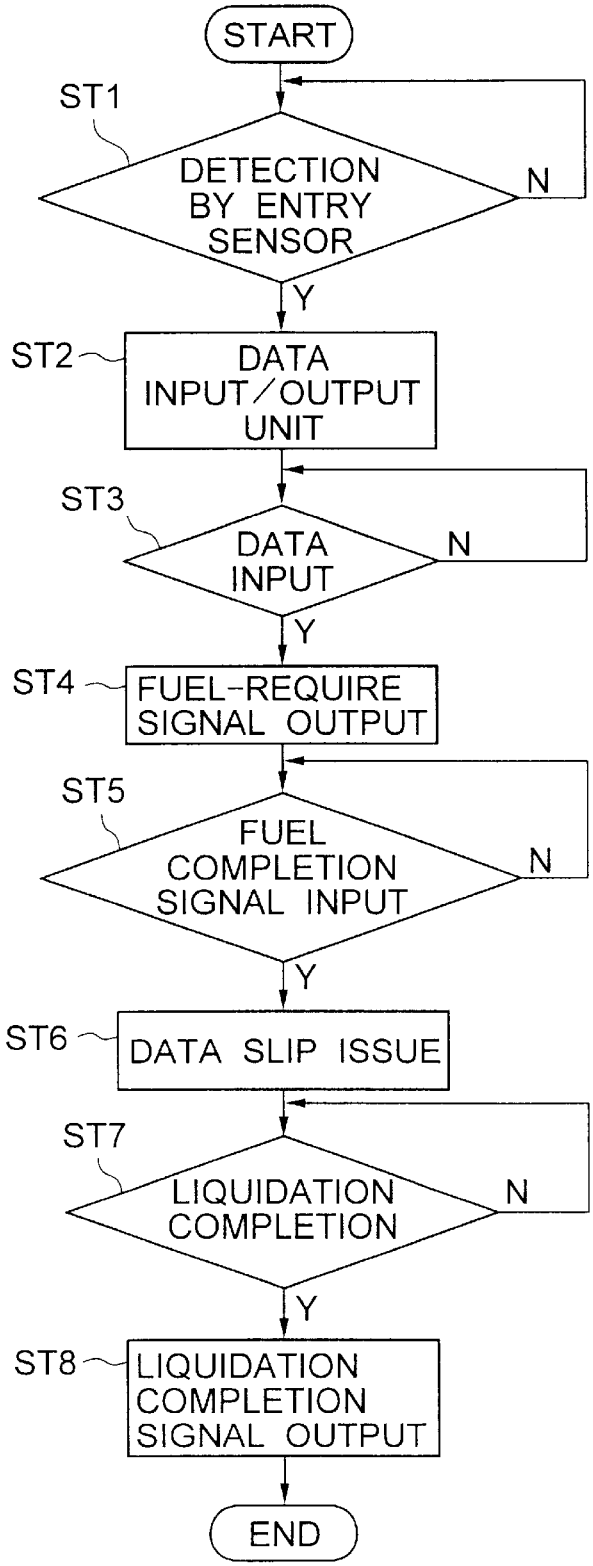
FIG. 4 is a flow-chart for explaining the function of a data input/output unit for use in the present invention.

The function of the fueling system according to the present invention will now be explained in detail with referring to FIGS. 4 to 6.

When there is no car in a fueling area 2, the entry sensor 6 does not detect a car, so that the corresponding interceptor 40 holds the interception arm 40*b* in a hung down position, with the individual fuel-state communicator and the central fuel-state communicator completely turned off.

In the case where a car comes into the fueling area 2 from an entry passage 1, and the entry sensor 6 detects the car (ST1), a conveyance unit 31 is caused to work, so that the data input/output unit 30 moves to a fueling area 2 side (ST2) at which a car stops, traveled along the travel path 30*c*. The customer inputs fueling data such as a fuel sort and a fuel quantity from the data input mobile 30*d* or the keyboard 30*i* sitting in the car (ST3). Thus, a fuel-require signal is output from the control portion 30*k* to the individual and central fuel-state communicators 20 and 50 (ST4).

Figure 5:
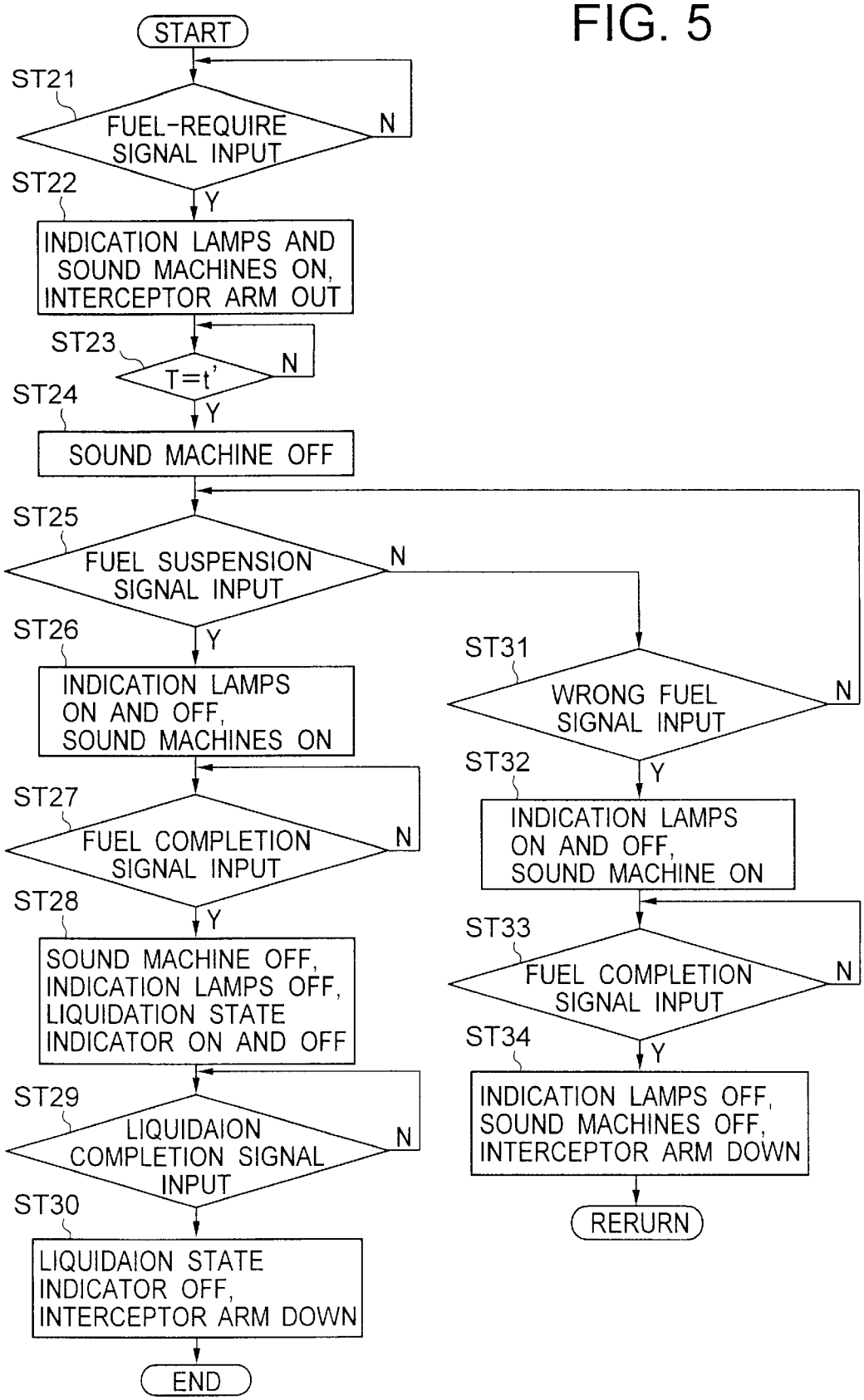
FIG. 5 is a flow-chart for explaining the function of fuel-state communicators for use in the present invention.

Then, the individual fuel-state communicator 20 and the central fuel-state communicator 50 start to function following the flow-chart in FIG. 5.

When the fuel-require signal is input from the input mobile 30*d* or the keyboard 31*i* (ST21), the individual-communicator indication lamp 20*c* and the central-communicator indication lamp 50*d* are turned on, which are respectively of the individual fuel-state communicator 20 on the fueling machine 10 provided in the fueling area 2 where a car has come in, and the central fuel-state communicator 50; and the individual-communicator sound machine 20*a* and the central-communicator sound machine 50*c* produce sounds, each of which is peculiar to the fueling area 2. Simultaneously, the interceptor 40 functions by rotating the interception arm 40*b* protruded to the horizontal position, that is, a leave-impossible position (ST22). With the lapse of a certain period of time (t') (ST23) from the input of the fuel-require signal, the sound machines 20*a* and 50*c* stop making sounds (ST 24). Accordingly, fueling operators can know in which fueling area 2 a car waits for being fueled. It becomes possible not to make the car leave during the fueling operation, or before the clearing off after the fueling completion.

The function of the fueling machine 10 will now be explained with referring to the flow-chart of FIG. 6. A fueling operator who has noticed the arrive of a customer by the lights and sounds made by the communicators 20 and 50 comes up to the fueling area 2 and takes a fueling nozzle 10*d* from a nozzle rest 10*f* (fuel sort to be selected has been input to the outdoor input/output unit at the previously mentioned ST3 and is shown on the indication part 30*h* thereof, whereby a nozzle switch 10*g* is turned on (ST41). Then, the control part 10*h* of the fueling machine 10 brings back the previous fuel amount indication shown on the display 10*i* to zero; outputs a fuel initiation signal to the individual and central fuel-state communicators 20 and 50; and causes to function the fuel-sort discrimination unit 10 (ST42).

In this state, the fuel operator inserts a required fueling nozzle 10*d* to the fuel port of the car, so that the fuel-sort discrimination unit 10 judges whether or not the fuel sort remains in the tank of the car is identical with the one to be fueled, by the vapor absorption from a vapor absorption port of the fueling nozzle 10*d*. Fueling is started when the fuel sorts are identical (ST43), with the pump being driven (ST44). Once fueling is started, the control part 10*h* judges whether or not the full-tank fueling (fueling to the full-tank level) should be performed (ST45). The full-tank fuel unit 10*k* is caused to work (ST46) when the full-tank fueling has been instructed. To the contrary, if the full-tank fueling has not been instructed, the control part 10*h* judges whether or not the pre-set fueling (fueling to a predetermined level) should be started (ST51). The pre-set fueling unit 101 is caused to work (ST52) when the pre-set fueling has been set. The fuel amount calculated by the flow-meter 10*c* during the fueling is shown on the display 10*i*.

When the full-tank fueling is detected by the function of the full-tank fueling unit 10*k* (ST47) or when the pre-set fueling is detected by the function of the pre-set fueling unit 101(ST53), the control part 10*h* stops the pump 10*b* and outputs a fuel suspension signal to the individual and the central fuel-state communicators 20 and 50 (ST48). Thus, the individual-communicator control section 20*e* and the central-communicator control section 50*f* receive the fuel suspension signal (ST25, FIG. 5), followed by the individual- and central-communicator indication lamps 20*c* and 50*d* being turned on and off, and the sound machines 20*d* and 50*c* turned on (ST26). According to the function of the communicators, fueling operator can be involved in other matters while fueling is performed, since the completion of the fueling is clearly notified.

The fueling operator comes to the fueling machine 10 which finished fueling, by the notice of the indication lamps 20*c* and 50*d* and the sound machines 20*d* and 50*c*. The fueling operator takes the fueling nozzle 10 out of the fueling port of the car, and bring it back onto the nozzle rest 10*f*, so that the nozzle switch 10*g* is turned off (ST49). The control part 10*h* outputs the fuel completion signal to the outdoor input/output unit 30, and to the individual and central fuel-state indicators 20 and 50 (ST50).

The individual-communicator 20 and the central-communicator 50 of which indication lamps 20*c* and 50*d*, and sound machines 20*d* and 50*c* are turned on (ST26 in FIG. 5) receive the fuel completion signal at the control section 20*e* and the control section 50*f* (ST27). Under the receipt of the fueling completion signal, the indication lamps 20*c* and 50*d*, and sound machines 20*d* and 50*c* are turned off, and the liquidation state indicator 50*e* is turned on and off (ST28), whereby fueling operators knows that the customer is in liquidation.

On the other hand, the control portion 30*k* of the data input//output unit 30, which has received the fuel completion signal (FIG. 4, ST5), performs liquidation after the insertion of money to the money insertion port 30*f* or a card to the card insertion port 30*e*, gives change from the change discharge port 30*g* if necessary, and the printer 30*j* issues a fueling data slip (ST6). With the completion of the liquidation (ST7), the control portion 30*k* outputs a liquidation completion signal to the central fuel-state communicator 50 and the interceptor 40 (ST8).

The central communicator control section 50*f*, which has received the liquidation completion signal (FIG. 5, ST29), turns off the light of the liquidation state indicator 50*e*, and rotates the interception arm 40*e* of the interceptor 40 to hung it down (ST30).

In the case where the fuel sorts are judged as non-identical (ST54) as the result of the judgment made by the fuel-sort discrimination unit 10*j* previously described in connection with FIG. 6 (ST 43), the control part 10*h* of the fueling machine 10 outputs a wrong-fuel signal to the individual and central fuel-state indicators 20 and 50 (ST55). On the other hand, the individual- and central-communicator control sections 20*e* and 50*f* which have received the wrong fuel signal (FIG. 5, ST31) turn on and off their indication lamps 20*c* and 50*d*, and turn on the sound machines 20*d* and 50*c* (ST32) to notify that the wrong fuel sort is going to be dispensed.

Figure 6:
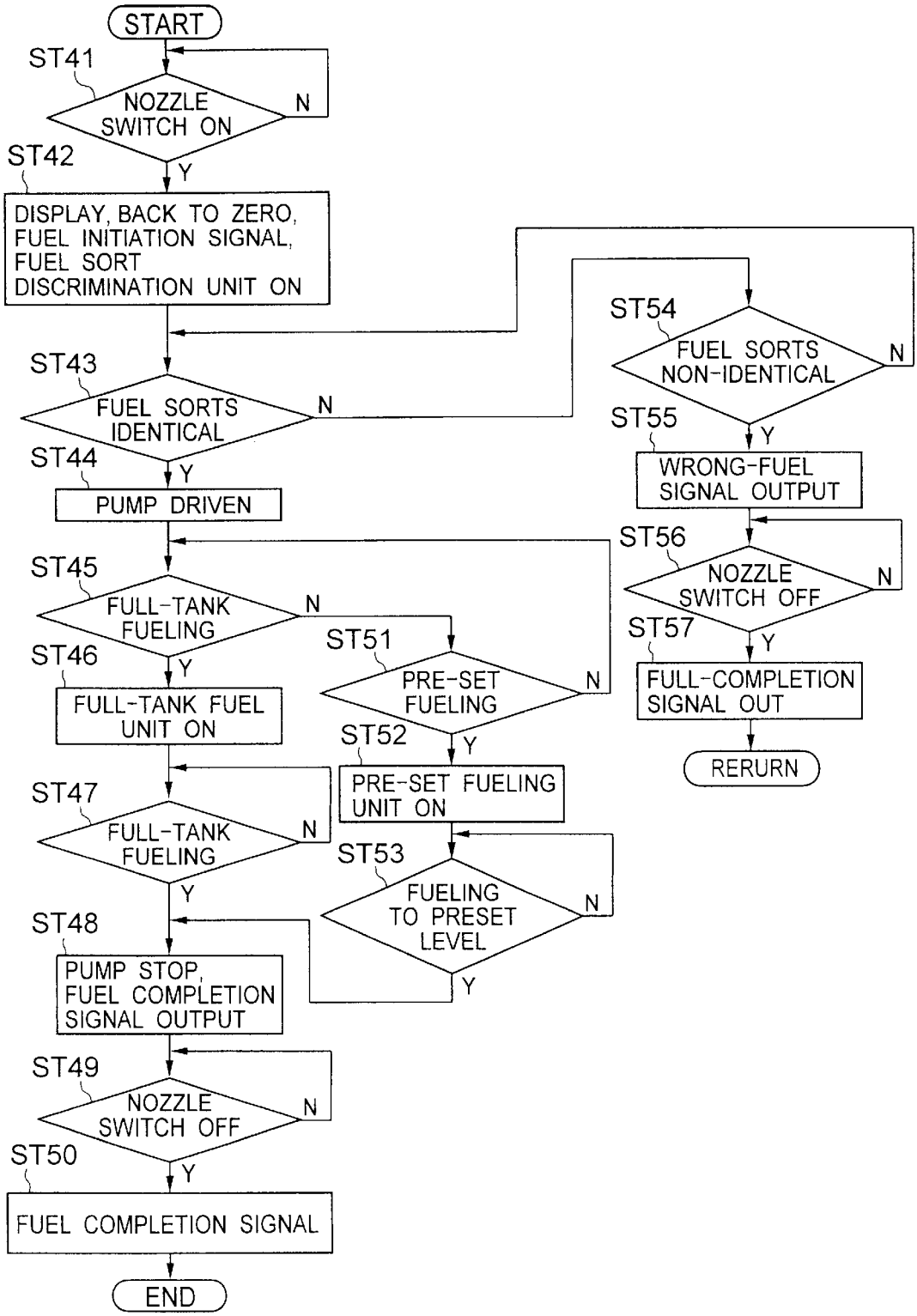
FIG. 6 is a flow-chart for explaining the function of a fueling machine for use in the present invention.

After the nozzle 10*d* of the wrong fuel sort is hung on the nozzle rest 10*f*, the nozzle switch 10*g* is turned off (FIG. 6, ST56). In this state, the fuel completion signal is output from the control part 10*h* (ST57) to the individual- and central-communicator control sections 20*e* and 50*f* (ST33 in FIG. 5), by which the individual- and central-communicator indication lamps 20*c* and 50*d* are turned off, and the individual- and central-communicator sound machines 20*d* and 50*c*, and the interception arm 40*b* is rotated to be hung down (ST34). In this case, a fueling operation is started again from the beginning, by taking a nozzle of a correct fuel sort out of the corresponding fueling nozzle 10*f*.

In the above embodiment, it is described as that there are employed both the individual fuel-state communicator 20 provided on each of the fueling machine 10 and the central fueling-state communicator 50 provided on the outer wall of the office T. The provision of the two types of the communicators 20 and 50 are not always necessary.

The selection of the communicators, that is, the decision to use the both the communicators 20 and 50 or to use either of the communicators 20 or 50, can be appropriately made depending on the required situation with the installation cost, and the operation efficiency or the like taken into consideration.

Moreover, it is also possible to prepare a communicator with either of an indication lamp or a sound machine, for visually or auditory indicating the fueling state.

As is obvious from the above explanation, it is possible to effectively perform the fueling operation by use of the fueling system of the present invention, with reducing a fueling cost with the customer taking partial charge of jobs in the gas station, without giving a feeling of inconvenience to the customer nor subjecting the customer to the annoying or dangerous condition.

What is claimed is:

1. A fueling system to be provided in a gas station comprising:

at least one fueling machine in a fixed location, the at least one fueling machine being non-movable; and a data input/output unit, the data input/output unit being exclusively linearly movable in a back and forth direction relative to the at least one fueling machine so that the data input/output unit is accessible from cars parked in parallel on either side of the data input/output unit, and fueling data being input from the data input/output unit and being output to the fueling machine.

2. The fueling system to be provided in a gas station as claimed in claim 1, further comprising an entry sensor for sensing one of the cars at a fueling area wherein fueling is performed, and a conveyance unit which moves the data input/output unit toward said one of the cars in response to detection of a signal from the entry sensor.

3. The fueling system to be provided in a gas station as claimed in claim 2, further comprising a fuel-state communicator for indicating fueling states of the fueling machine provided at a place visible from most parts of the gas station, the fuel-state communicator indicating the fueling states by the receipt of signals from the data input/output unit and the fueling machine.

4. The fueling system to be provided in a gas station as claimed in claim 3, wherein the fuel-state communicator comprises an indication lamp which is turned on, turned on and off, and turned off depending upon the fueling states.

5. The fueling system to be provided in a gas station as claimed in claim 3, wherein the fuel-state communicator comprises a sound machine which indicates the fueling states by several sorts of sounds.

6. The fueling system to be provided in a gas station as claimed in claim 1, wherein the data input/output unit further has a function of settling a fueling account.

7. A fueling system to be provided in a gas station comprising:

a plurality of fueling machines;

at least one data input/output unit exclusively linearly movable back and forth by a conveyance unit so that the data input/output unit is accessible from cars parked in parallel on either side of the data input/output unit, fueling data being input from the data input/output unit and being output to the fueling machines;

entry sensors, each for sensing one of the cars at a fueling area wherein fueling operation is performed; the data input/output unit being moved toward said one of the cars by means of the conveyance unit in response to detection of a signal from each of the entry sensors; and a fuel-state communicator separate from the plurality of fueling machines, the communicator being visible from most parts of the gas station and providing information to an attendant, the fuel-state communicator indicating fueling states by receipt of signals from the data input/output units and the fueling machines and providing information about all of the plurality of fueling machines.

8. The fueling system to be provided in a gas station as claimed in claim 7, wherein the data input/output unit further has a function of settling a fueling account.

9. The fueling system to be provided in a gas station as claimed in claim 7, wherein the fuel-state communicator is provided in the fueling area, the fuel-state communicator comprising an indication lamp which is turned on, turned on and off, and turned off depending upon the fueling states.

10. The fueling system to be provided in a gas station as claimed in claim 9, wherein the fuel-state communicator is provided in the fueling area, the fuel-state communicator comprising a sound machine which gives different sounds depending on the fueling areas and the fueling states.

11. The fueling system to be provided in a gas station as claimed in claim 7, wherein the fuel-state communicator is provided in the fueling area, the fuel-state communicator comprising a sound machine which gives different sounds depending on the fueling areas and the fueling states.

12. The fueling system to be provided in a gas station as claimed in claim 7, wherein the fuel state communicator is composed of individual fuel-state communicators respectively provided on the fueling machines.

13. The fueling system to be provided in a gas station as claimed in claim 7, wherein each of the fueling machines are fixed and non-movable and wherein each of the fueling machines have one of the at least one data input/output units associated therewith, the data input/output units being linearly reciprocal relative to the associated fueling machine in order to be accessible from cars parked in parallel on either side of the associated fueling machine.

14. A fueling system to be provided in a gas station comprising:

at least one fueling machine in a fixed location, the at least one fueling machine being non-movable; and a data input/output unit, the data input/output unit being linearly movable in a back and forth direction relative to the at least one fueling machine so that the data input/output unit is accessible from cars parked in parallel on either side of the data input/output unit, and fueling data being input from the data input/output unit and being output to the fueling machine, the data input/output unit having a card insertion port, a money insertion port and a change port for receiving change.

15. A fueling system to be provided in a gas station comprising:

at least one fueling machine in a fixed location, the at least one fueling machine being non-movable;

a data input/output unit, the data input/output unit being linearly movable in a back and forth direction relative to the at least one fueling machine so that the data input/output unit is accessible from cars parked in parallel on either side of the data input/output unit, and fueling data being input from the data input/output unit and being output to the fueling machine; and an interceptor provided proximate to the at least one fueling machine, the interceptor having a pivotable arm which in a raised position blocks an exit from adjacent the at least one fueling machine such that the arm will prevent a vehicle from leaving the at least one fueling machine until a fueling operation is complete.

16. A fueling system to be provided in a gas station comprising:

a plurality of fueling machines;

at least one data input/output unit movable back and forth by a conveyance unit so that the data input/output unit is accessible from cars parked in parallel on either side of the data input/output unit, fueling data being input from the data input/output unit and being output to the fueling machines;

entry sensors, each for sending one of the cars at a fueling area wherein fueling operation is performed; the data input/output unit being moved toward said one of the cars by means of the conveyance unit in response to detection of a signal from each of the entry sensors; and a fuel-state communicator separate from the plurality of fueling machines, the communicator being visible from most parts of the gas station and providing information to an attendant, the fuel-state communicator indicating fueling states by receipt of signals from the data input/output units and the fueling machines and providing information about all of the plurality of fueling machines, the data input/output unit having a card insertion port, a money insertion port and a change port for receiving change.

17. A fueling system to be provided in a gas station comprising:

a plurality of fueling machines;

at least one data input/output unit movable back and forth by a conveyance unit so that the data input/output unit is accessible from cars parked in parallel on either side of the data input/output unit, fueling data being input from the data input/output unit and being output to the fueling machines;

entry sensors, each for sending one of the cars at a fueling area wherein fueling operation is performed; the data input/output unit being moved toward said one of the cars by means of the conveyance unit in response to detection of a signal from each of the entry sensors;

a fuel-state communicator separate from the plurality of fueling machines, the communicator being visible from most parts of the gas station and providing information to an attendant, the fuel-state communicator indicating fueling states by receipt of signals from the data input/output units and the fueling machines and providing information about all of the plurality of fueling machines; and an interceptor provided proximate to each of the fueling machines, the interceptors having pivotable arms which in a raised position block an exit from adjacent the fueling machine such that the arm will prevent a vehicle from leaving the fueling machine until a fueling operation is complete.

* * * * *

UNITED STATES PATENT AND TRADEMARK OFFICE

CERTIFICATE OF CORRECTION

PATENT NO. : 6,488,057 B1
DATED : December 3, 2002
INVENTOR(S) : Tatsuno, Hiyoshi It is certified that error appears in the above-identified patent and that said Letters Patent is hereby corrected as shown below:

Column 10,
Lines 3 and 28, change "each for sending" to -- each for sensing --.

Signed and Sealed this

Sixth Day of May, 2003

JAMES E. ROGAN
*Director of the United States Patent and Trademark Office*